US005175897A

United States Patent [19]

Marra, Jr.

[11] Patent Number: 5,175,897

[45] Date of Patent: * Jan. 5, 1993

[54] COVER FOR HOSPITAL BED RAILS

[76] Inventor: John J. Marra, Jr., 1701 Olympus Dr., Sacramento, Calif. 95865

[ * ] Notice: The portion of the term of this patent subsequent to Mar. 24, 2009 has been disclaimed.

[21] Appl. No.: 899,320

[22] Filed: Jun. 16, 1992

Related U.S. Application Data

[63] Continuation-in-part of Ser. No. 855,257, Mar. 23, 1992, abandoned, which is a continuation of Ser. No. 716,516, Jun. 17, 1991, Pat. No. 5,097,550.

[51] Int. Cl.[5] ..... A47C 27/08

[52] U.S. Cl. ..... 5/425; 5/427; 5/663

[58] Field of Search ..... 5/424, 425, 427, 473, 5/484, 485, 486, 663; 150/154, 159, 165

[56] References Cited

U.S. PATENT DOCUMENTS

| | | | |
|---|---|---|---|
| 3,566,414 | 3/1971 | Basner | 4/1 |
| 3,619,824 | 11/1971 | Doyle | 5/93 |
| 3,742,530 | 7/1973 | Clark | 5/331 |
| 4,183,015 | 1/1980 | Drew et al. | 340/286 |
| 4,215,446 | 8/1980 | Mahoney | 5/425 |
| 4,370,765 | 2/1983 | Webber | 5/482 |
| 4,484,367 | 11/1984 | Jenkins | 5/485 |
| 4,672,698 | 6/1987 | Sands | 5/424 |
| 4,827,545 | 5/1989 | Arp | 5/424 |
| 4,932,524 | 6/1990 | Hodson | 206/320 |
| 5,044,025 | 9/1991 | Hunsinger et al. | 5/424 |
| 5,097,550 | 3/1992 | Marra, Jr. | 5/424 |

*Primary Examiner*—Michael F. Trettel

*Attorney, Agent, or Firm*—Burns, Doane, Swecker & Mathis

[57] ABSTRACT

A bed rail cover system including a bed rail having a framework with a plurality of rails and a cover positionable over the framework. The cover is of unitary construction, includes an attachment flap engageable with one of the rails to secure the cover in position on the framework, and includes an aperture therein to provide access to a control panel or other equipment in the framework. Optionally the cover can include a cover flap for the aperture, which cover flap can be similar to the other cover material or can be a transparent, flexible cover for visual and operational access through the transparent, flexible cover flap.

12 Claims, 1 Drawing Sheet

COVER FOR HOSPITAL BED RAILS

RELATED APPLICATIONS

This application is a continuation-in-part of application Ser. No. 07/855,257 filed Mar. 23, 1992, now abandoned, which is a continuation of Ser. No. 07/716,516 filed Jun. 17, 1991, now U.S. Pat. No. 5,097,550, which are incorporated herein by reference.

TECHNICAL FIELD

This invention relates to a bed rail cover system. More particularly, the invention has particular application to hospital beds and relates to an apparatus for covering the rails of same in a manner providing optimum safety, comfort and convenience for both the patient and the nurse or other attendant.

BACKGROUND ART

Hospital beds employed in hospitals and other health care facilities commonly incorporate what are known as safety sides or bed rails to provide protection for the patient. A particular from of bed rail in common usage is an open framework comprised of top and bottom rails and end rails connecting same. Typically, the frameworks may be selectively moved to and from a vertical position by the nurse or other attendant. The frameworks are of rigid construction, commonly being formed of metal tubing having a rectangular cross-section. One or more of the frameworks, which are independently movable relative to one another, may be disposed on both sides of the bed frame. An example of a hospital bed construction of this type is the Hill Rom 840 Hospital Bed or the "Advance 2000" Bed manufactured by Hill-Rom, Batesville, Ind. The aforementioned models additionally comprise equipment housing means housing bed configuration control means, communications equipment and the like operable by either the patient or the attendant.

Since the framework is constructed of a hard, nonyielding metal material a patient can become injured when making contact therewith. This problem becomes particularly acute if the patient's condition results in, or is a contributing factor to, patient motion while he or she is confined to the bed by the bed rails.

The present invention includes a cover of a particular character which cooperates with a hospital bed rail in a particular manner to effectively eliminate injury to a patient, or attendant for that matter, due to physical contact with the bed rail. While it is known to provide covers for bed rails generally, prior art arrangements have not been fully effective in cushioning the bed rail framework in its entirety. Furthermore, prior art approaches have interfered with manipulation and placement of the bed rail by attendants. Also, prior art cover arrangements are often characterized by a propensity to become soiled and difficult to clean, particularly undesirable characteristics in a hospital or other health care environment. Additionally, prior art cover approaches have made it difficult, if not impossible, to manually access control equipment or other equipment associated with the bed rail without completely removing the cover.

DISCLOSURE OF INVENTION

The cover of the present invention is of such a construction as to obviate the above-described difficulties with regard to prior art arrangements for cushioning bed rails.

The cover is employed in combination with bed rail means including a framework defining an opening and including a generally horizontally disposed top rail, a generally horizontally disposed bottom rail spaced from the top rail, and a pair of end rails spaced from each other and interconnecting the top and bottom rails. The bottom rail is connected to a bed frame by connector elements extending between the bottom rail and the bed frame.

The cover of the present invention is of unitary construction and includes first and second primary cover elements spaces from one another and having an outer peripheral configuration generally corresponding to the outer peripheral configuration of the framework.

The cover also includes a top cover element extending between the first second primary elements at upper edges of the first and second primary elements as well as side cover elements extending between the first and second primary cover elements at side edges of the first and second primary cover elements and downwardly from the top cover element.

The primary cover elements, the top cover element and the side cover elements each can be of multi-wall construction which includes a flexible outer wall, a flexible inner wall, and a layer of resilient material disposed between the flexible outer and inner walls of all of the cover elements or can be single layer molded element. Whether multi-wall or single layer construction each element can be adapted to provide sufficient flexibility and resilience to effectively pad the framework to substantially protect the patient from injury thereon.

The cover defines an interior for snugly receiving the framework and the primary and side cover elements define an opening communicating with the interior for allowing ingress and egress of the framework relative to the interior.

Attachment means is provided for releasably attaching the cover to the framework when the framework projects through the opening and is snugly retained within the cover interior.

The bed rail means additionally comprises equipment housing means at a predetermined location thereon within the framework. The cover defines an aperture disposed in at least partial registry with the equipment housing means when the framework is disposed within the cover interior with the framework covered by the cover to permit manual access to the equipment housing means. The aperture can further comprise a cover flap to close the aperture when desired and can further comprise a flexible transparent cover to provide visual and functional access to operation of the equipment housing means through the aperture while providing protection of the equipment housing means from contamination.

The aforesaid attachment means comprise a securement flap attached to one of the primary cover elements and having a distal end. The securement flap is bent about and in engagement with a preselected rail of the framework when the framework projects through the opening and is snugly retained within the cover interior.

The cover additionally includes connector means for releasably securing the securement flap distal end to the other primary cover element. A particular connector means which has been found to be effective comprises selectively engageable synthetic attachment members such as hook and loop strips sold under the trade designation "VELCRO", affixed to the securement flap and the other primary cover element.

Other features, advantages and objects of the present invention will become apparent with reference to the following description and accompanying drawings.

BEST MODE FOR CARRYING OUT THE INVENTION

Figure 1:
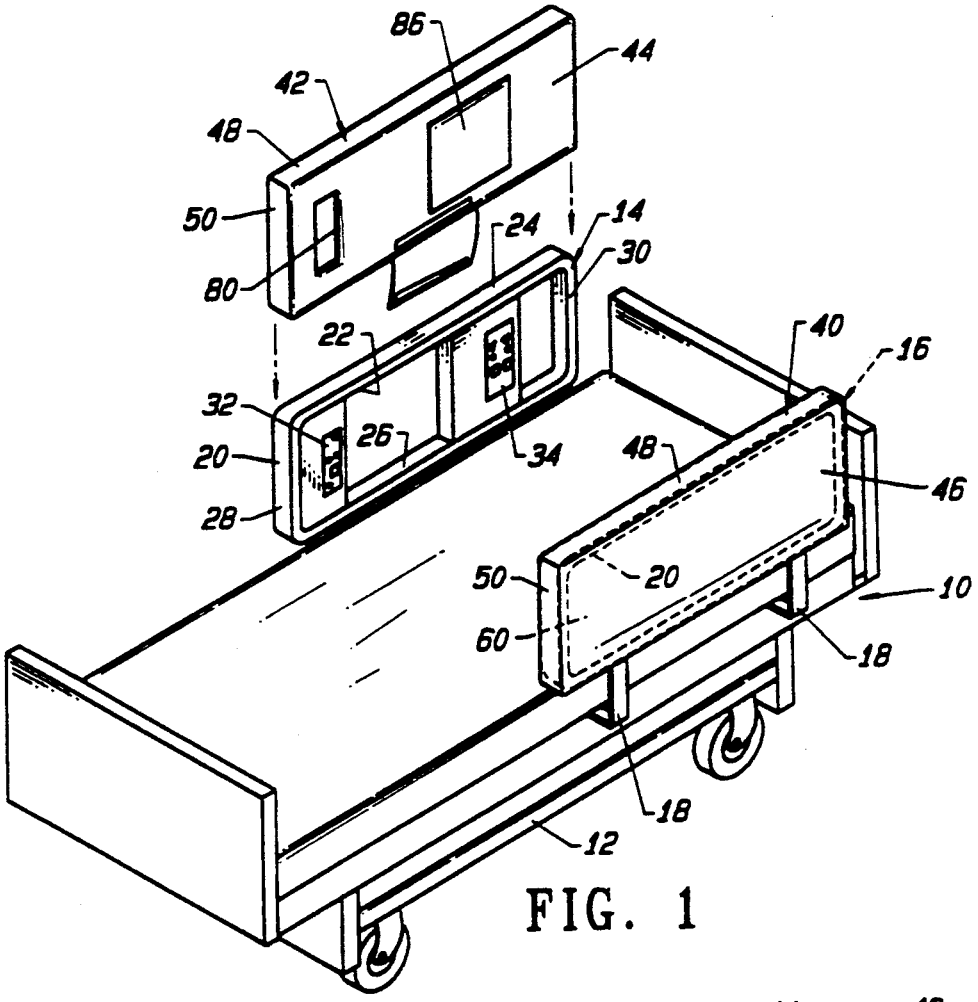
FIG. 1 is a perspective view of a hospital bed having two bed rails, one of which is covered by a cover constructed in accordance with the teachings of the present invention while the other has a cover disposed thereabove prior to positioning of the cover.
Figure 2:
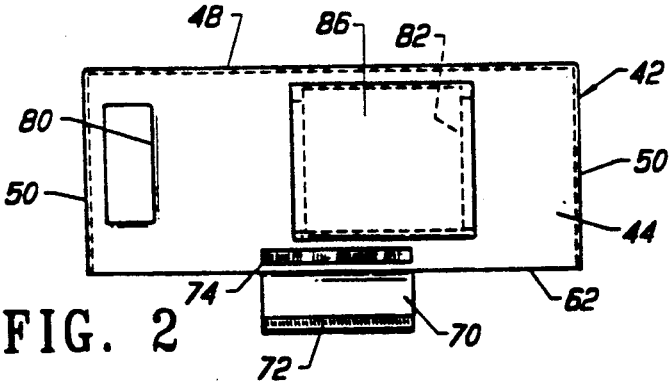
FIG. 2 is a side elevation view of one of the covers shown in FIG. 1.

Referring now to FIGS. 1–4 of the drawings, a hospital bed 10 having a wheeled bed frame 12 is illustrated. Hospital bed 10 additionally includes a pair of bed rails 14, 16 which are connected to the bed frame 12 by connector elements 18 which, as is conventional, allow movement of the bed rails relative to the bed frame from the vertical position illustrated to a lowered position. Such an arrangement is conventional and will not be described in detail. It will be appreciated that rather than having one bed rail to a side, as shown in FIG. 1, the hospital bed 10 may have two or more bed rails to a side, each of which is independently movable with respect to the bed frame. The principles of the present invention are applicable to a hospital bed having any number of bed rails.

Each bed rail is in the form of a framework defining an opening 22 and including a generally horizontally disposed top rail 24, a generally horizontally disposed bottom rail 26 spaced from the top rail, and a pair of end rails 28, 30 spaced from each other and interconnecting the top and bottom rails. The connector elements 18 extend between the bottom rail and the bed frame. Bed rails of the type disclosed are commonly referred to in the health care industry as safety sides.

Bed rails 14, 16 are of well known construction and do not per se comprise the present invention. Bed rails of the general type may, for example, be found on the Hill-Rom 840 Hospital Bed or the Hill-Rom "Advance 2000" Bed identified above. Some variance may exist between the bed rails. For example, bed rail 14 includes two housings 32, 34 for accommodating equipment such as controls for adjusting the configuration of the bed or communications apparatus such as a telephone or intercom.

According to the teaching of the present invention, a cover is provided over each bed rail to afford protection for the patient by preventing him or her from engaging an exposed hard surface of the bed rail during convulsions, disorientation or other conditions, which in some circumstances can cause injury. In FIG. 1, bed rail 16 has a cover 40 constructed in accordance with the teachings of the present invention already in position and covering same. A cover 42 is illustrated in FIG. 1 as being disposed over bed rail 14 prior to placement thereon.

Each cover is of unitary construction and includes first and second primary cover elements 44, 46, respectively, spaced from one another and having an outer peripheral configuration generally corresponding to the outer peripheral configuration of the framework 20.

In addition, each cover includes a top cover element 48 extending between the first and second primary cover elements at upper edges thereof. Side cover elements 50 extend between the first and second primary cover elements at side edges thereof and downwardly from the top cover element.

Figure 4:
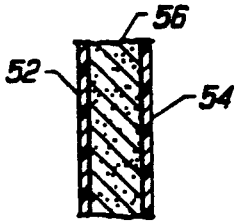
FIG. 4 is an enlarged, cross-sectional view of a predetermined segment of the cover.

The primary cover elements, the top cover element, and the side cover elements are each of multi-wall construction. This construction is illustrated in FIG. 4 and includes a flexible outer wall 52, a flexible inner wall 54, and a layer of resilient material 56 disposed therebetween.

The flexible inner and outer walls are formed of liquid impermeable sheet plastic material of any suitable type. The layer of resilient material 56 preferably comprises closed-cell plastic foam material. The top cover element, the side cover elements, and the primary cover elements may be secured together in any desired fashion, such as by stitching, heat sealing or the like. In any event, the cover when assembled as above describe constitutes a unitary structure which will provide protective padding on both sides of the framework with which it is associated as well as at the top and sides thereof.

Each cover defines an interior 60 for snugly receiving its associated framework. The primary and side cover elements define an opening 62 communicating with the interior for allowing ingress and egress of the framework relative to the interior.

In an alternative embodiment of this invention either or both of side cover elements 50 may be detachably attached to either or both of the first and second primary cover elements of 44, 46 respectively, by "VELCRO" hook and loop means, zipper means and the like which may enable easier ingress and egress of the framework relative to the interior of the cover. This may be particularly desirable when the framework is of a configuration where it is wider at the top than the bottom whereby placement of the cover over the framework will be easier if either or both of the side cover elements 50 can be detached from either or both primary cover elements 44, 46 then reattached after the cover is installed on the framework.

In another embodiment of this invention it will be apparent to one skilled in the art that the cover can be constructed of a unitary molded unit providing the appropriate opening 62 for ingress and egress of the framework relative to the interior of the cover unit. For example, the cover unit can be molded by injection molding, foam injection molding, etc. where first and second primary cover elements 44 and 46 top cover element 48 and side cover elements 50 all constitute one single unitary molded cover. In addition, securement flap 70 can also be molded at the same time as part of the unitary molded cover. As above, either or both sides can be detachable for convenient placement on the framework and then reclosed after in place on the framework. Such a molded unitary structure can be constructed so that each wall of the cover is a single layer of material adapted to provide appropriate padding on each part of the framework. For example, a molded foam which forms an appropriate surface skin upon molding can be conveniently used to enable a single step molding operation for forming each cover. Such molded covers will have the advantage of economy of manufacture and a range of materials available for satisfying the requirements to be met such as thickness for padding, surface cleanability, flame resistance, and the like. Further economy can be achieved by molding the cover to provide thicker padding on the portions of the framework where patient protection is important and thinner walls where patient protection is not important.

In another alternative embodiment of the present invention it will be apparent to one skilled in the art that each cover can be constructed from various materials adapted to satisfy various requirements which may be desired for particular patient protection or for use in a particular environment. For example, the covers may be molded or constructed from highly durable padding material which can withstand numerous cleaning cycles with various cleaning materials or chemicals. Alternatively, the cover can be constructed of fabric-like materials, which can be designed for a single use or daily use application, wherein the cover can be removed and laundered for reuse.

Figure 3:
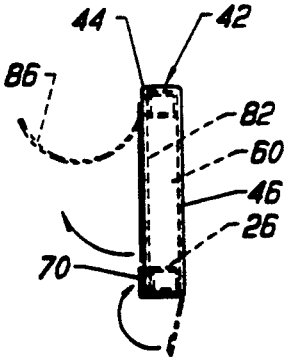
FIG. 3 is an end elevation view illustrating diagrammatically operationally features of the cover and a bed rail covered thereby.

Each cover further includes attachment means for releasably attaching the cover to its associated framework when the framework projects through the opening 62 and is snugly retained within the cover interior. More particularly, the attachment means is in the form of a securement flap 70 which may be formed of the same material as the outer and inner walls 52, 54. Flap 70 is sewn to or otherwise affixed to the bottom of one of the primary cover elements and is bent about bottom rail 26, as shown in FIG. 3, when the cover receives its associated framework. The securement flap 70 at its distal end has affixed thereto a strip of synthetic attachment material, for example, "VELCRO" hook and loop 72. A strip 74 of like construction is located on the primary cover element opposed to the cover element to which the securement flap 70 is fixedly attached. The strips 72, 74 are brought into engagement to releasably retain the securement flap in engagement with the bottom rail 26 and thus maintain the cover in position relative to the framework. The securement flap may be fixedly connected to either of the primary cover elements. As illustrated, the securement flap 70 is fixed attached to second primary cover element 46.

Cover 42 defines two apertures 80, 82. When the cover 42 is positioned on bed rail or safety side 14, aperture 80 is in at least partial registry with housing 32 and aperture 82 is in at least partial registry with housing 34. Thus, the patient and/or attendant have manual access to the housing through their respective associated apertures. A cover flap 86 is secured to first primary cover element 44 above aperture 82 to cover the aperture and housing 34 when desired. Preferably, the cover flap 86 is constructed of the same material as the primary cover elements.

Other embodiments will be apparent to one skilled in the art. For example, either or both of apertures 80 or 82 can be an aperture which passes completely through all layers of primary cover element 44. Alternatively, either or both may be an aperture which is covered with a flexible cover flap 86 which is transparent to enable visual access to the equipment housing means and is sufficiently flexible to allow operation of the control buttons in the equipment housing means by pushing the control buttons through the flexible transparent cover much like the protective transparent covers for keyboards, similar to those used on cash register key pads in potentially contaminating environments. Such a transparent protective cover over the aperture can provide full visual and operational access to the individual control means and the equipment housing means and also protect the equipment housing means from contamination. Such transparent cover flap 86 can also be detachably removable and replaceable if desired or can be permanently attached or molded into the cover. In addition, cover flap 86 may incorporate multiple cover flaps 86 on a particular aperture. For example, one cover flap can be transparent and permanently attached and a second cover flap on the same aperture can be opaque, padded and detachable or openable to provide a padded cover for the equipment housing means.

Figure 5:
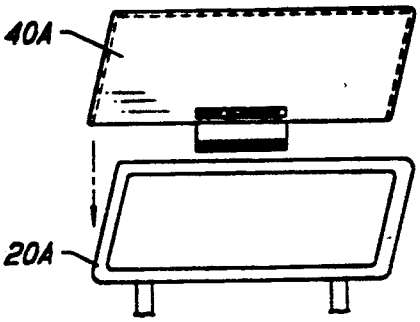
FIG. 5 is a side elevation view of an alternative form of bed rail and cover with the cover located over the bed rail prior to positioning thereon.

FIG. 5 discloses an alternative form of framework 20A in the form of a non-rectangular parallelogram. Cover 40A is of the same general configuration and snugly receives the framework when positioned thereon.

What is claimed is:

1. In combination:

bed rail means including a framework defining an opening and including a generally horizontally disposed top rail, a generally horizontally disposed bottom rail spaced from said top rail, and a pair of end rails spaced from each other and interconnecting said top and bottom rails, said bottom rail being connected to a bed frame by connector elements extending between said bottom rail and said bed frame, and said bed rail means having equipment housing means at a predetermined location within said framework;

a cover of unitary construction for said bed rail means, said cover including first and second primary cover elements spaced from one another and having an outer peripheral configuration generally corresponding to the outer peripheral configuration of said framework, a top cover element extending between said first and second primary cover elements at upper edges of said first and second primary cover elements, and side cover elements extending between and connected to said first and second primary cover elements at side edges of said first and second primary cover elements along the lenghts of said side edges and downwardly from said top cover element whereby the cover is closed at the sides to cover said end rails, said first primary cover element, said top cover element and said side cover elements each being of construction adapted to provide flexible and resilient cover elements for padding said framework, said cover defining an interior for snugly receiving said framework, said first and second primary and said side cover elements defining an opening communicating with said interior for allowing ingress and egress of said framework relative to said interior, and said cover additionally defining an aperture disposed in at least partial registry with said equipment housing means when said framework is disposed within said cover interior with said framework covered by said cover to permit manual access to said equipment housing means, said aperture being located in the first primary cover element and adapted to provide access through said primary cover element to said equipment housing means; and attachment means for releasably attaching said cover to said framework when said framework projects through said opening and is snugly retained within said cover interior.

2. The combination according to claim 1 wherein said bed rails means additionally comprises equipment housing means at a predetermined location thereon within said framework, said cover defining an aperture disposed in at least partial registry with said equipment housing means when said framework is disposed within said cover interior with said framework covered by said cover to permit visual and manual access to said equipment housing means.

3. The combination according to claim 2 wherein said cover additionally comprises a cover flap attached to at least one of said primary cover elements and selectively positionable over said aperture.

4. The combination according to claim 1 wherein said attachment means comprises a securement flap attached to one of said primary cover elements and having a distal end, said securement flap being bent about and in engagement with a prescribed rail of said framework when said framework projects through said opening and is snugly retained within said cover interior.

5. The combination according to claim 4 wherein said securement flap distal end is engageable with the other of said primary cover elements, said cover additionally including connector means for releasable securing said securement flap distal end to said other primary cover element.

6. The combination according to claim 5 wherein said connector means comprises selectively engageable synthetic attachment members affixed to said securement flap and said other primary cover element.

7. The combination according to claim 1 wherein said primary cover, top cover and side cover elements are formed of liquid impermeable sheet plastic material.

8. The combination according to claim 7 wherein said cover is a single unit molded of plastic form material.

9. The combination according to claim 1 wherein said aperture comprises a transparent, flexible cover flap adapted to substantially cover said aperture, to provide visual access to said equipment housing means, to provide manual operation of said equipment housing means through said flexible member and to protect at least part of said equipment housing means from contamination.

10. The combination according to claim 9 wherein said cover flap is in part detachable from said aperture to provide open access to said equipment housing means.

11. The combination according to claim 1 wherein the aperture further comprises a transparent flexible cover flap thereon adapted for visual access and physical operation of the equipment housing means through the transparent aperture cover flap.

12. The combination according to claim 11 further comprising an opaque padded cover flap adapted to cover the aperture and the transparent flexible aperture cover flap.

* * * * *

UNITED STATES PATENT AND TRADEMARK OFFICE

CERTIFICATE OF CORRECTION

PATENT NO. : 5,175,897

DATED : January 5, 1993

INVENTOR(S) : John J. Marra, Jr.

It is certified that error appears in the above-identified patent and that said Letters Patent is hereby corrected as shown below:

In Column 6, lines 67 and 68 "the first primary cover element" is corrected to read --one of said primary cover elements--.

Signed and Sealed this

Second Day of November, 1993

Bruce Lehman

*Attest:*

BRUCE LEHMAN

*Attesting Officer*

*Commissioner of Patents and Trademarks*